US005298372A

United States Patent [19]

Okutsu et al.

[11] Patent Number: 5,298,372

[45] Date of Patent: Mar. 29, 1994

[54] METHOD FOR PROCESSING BLACK-AND-WHITE SILVER HALIDE PHOTOGRAPHIC MATERIAL

[75] Inventors: Eiichi Okutsu; Takashi Toyoda; Tadashi Ito, all of Kanagawa, Japan

[73] Assignee: Fuji Photo Film Co., Ltd., Kanagawa, Japan

[21] Appl. No.: 85,175

[22] Filed: Jul. 2, 1993

[30] Foreign Application Priority Data

Jul. 3, 1992 [JP] Japan ..... 4-177108
Mar. 26, 1993 [JP] Japan ..... 5-68631

[51] Int. Cl.[5] ..... G03C 5/31

[52] U.S. Cl. ..... 430/401; 430/434; 430/481

[58] Field of Search ..... 430/264, 363, 401, 434, 430/438, 440, 464, 480, 481, 483

[56] References Cited

U.S. PATENT DOCUMENTS 4,391,900 7/1983 Toyoda et al. ..... 430/438
5,194,367 3/1993 Yamada et al. ..... 430/363

FOREIGN PATENT DOCUMENTS 0273430 12/1987 European Pat. Off. .

*Primary Examiner*—Hoa V. Le
*Attorney, Agent, or Firm*—Sughrue, Mion, Zinn, Macpeak & Seas

[57] ABSTRACT

A method for processing a transmission type black-and-white photographic material using an automatic processor is disclosed, which comprises processing an imagewise exposed silver halide photographic material comprises silver chlorobromide, silver chloroiodide or silver chloroiodobromide grains having a silver chloride content of at least 90 mol % and a mean grain size of 0.1 to 0.4 μm or silver chloride grains having a mean grain size of 0.1 to 0.4 μm; the processing comprises developing in a developing bath and fixing in a fixing bath and the developing bath contains sodium ion in an amount comprising at least 70 mol % of the entire cation content of the developing bath; the developing bath and the fixing bath are each replenished in an amount of not more than 150 ml per $m^2$ of the silver halide photographic material processed; and the processing is carried out in an automatic processor.

11 Claims, No Drawings

METHOD FOR PROCESSING BLACK-AND-WHITE SILVER HALIDE PHOTOGRAPHIC MATERIAL

FIELD OF THE INVENTION

This invention relates to a method for processing a black-and white silver halide photographic material using an automatic processor, and more particularly to a method for processing a black-and-white silver halide photographic material which enables a reduction in the replenishment rates of the developing solution (i.e., bath) and the fixing solution (i.e., bath) per unit area of the photographic material processed, and moreover which method provides stable photographic performance.

BACKGROUND OF THE INVENTION

Generally, black-and-white silver halide photographic materials are processed through development, fixing, rinsing and drying stages after imagewise exposure to light. At present, most are processed with an automatic processor. Usually, the photographic materials are processed while the automatic processor is replenished with a given amount of the developing solution and a given amount of the fixing solution in proportion to the processed area of the photographic material. There is a demand for stable processing performance when such processing as described above is carried out. Furthermore, there is a demand for good processing performance and improved fixing property while further reducing the amounts of replenisher per unit area of the photographic material processed. Generally, at least 250 ml, particularly preferably at least 330 ml of each of the developing replenisher and the fixing replenisher have been conventionally used per $m^2$ processed of a sheet-form photographic material such as an X-ray photographic material or a graphic arts photographic material.

However, since the waste liquors of the developing solutions and the fixing solutions have high chemical oxygen demand (COD) or high biochemical oxygen demand (BOD), the developing waste liquor and the fixing waste liquor are chemically or biochemically treated to render them harmless, and the waste liquors are then discarded. The disposal of such waste liquors is expensive. Accordingly, there is a need to provide a processing method which enables the replenishment rates of the developing solution and the fixing solution to be reduced even further.

SUMMARY OF THE INVENTION

An object of the present invention is to provide a processing method which enables the replenishment rates of a developing bath and a fixing bath per unit area of photographic material processed to be reduced, in the processing of a transmission type black-and-white photographic material using an automatic processor.

Another object of the present invention is to provide a processing method which provides photographic characteristics having good stability even with reduced replenishment rates of the developing bath and the fixing bath.

The above-described objects of the present invention have been achieved by providing a method for processing a transmission type black-and-white silver halide photographic material which comprises processing an imagewise exposed silver halide photographic material comprising a support having thereon at least one light-sensitive silver halide emulsion layer comprising a silver halide emulsion, wherein said silver halide photographic material comprises silver chlorobromide, silver chloroiodide or silver chloroiodobromide grains having a silver chloride content of at least 90 mol % and a mean grain size of 0.1 to 0.4 μm or silver chloride grains having a mean grain size of 0.1 to 0.4 μm; said processing comprises developing in a developing bath and fixing in a fixing bath, the developing bath contains sodium ion in an amount comprising at least 70 mol % of the entire cation content of the developing bath; the developing bath and the fixing bath are each replenished in an amount of not more than 150 ml per $m^2$ of the silver halide photographic material processed; and the processing is carried out in an automatic processor.

DETAILED DESCRIPTION OF THE INVENTION

The present invention is illustrated in detail below.

The pH of developing bath for use in the present invention is preferably not higher than 10.0, particularly preferably 8.0 to 9.8.

The developing bath preferably contains a benztriazole derivative (preferably in an amount of $1\times10^{-6}$ to $1\times10^{-2}$ mol/l) or a nitroindazole (preferably in an amount of $1\times10^{-6}$ to $5\times10^{-3}$ mol/l). The fixing bath for use in the present invention preferably contains at least 0.8 mol (particularly 0.8 to 2.0 mol/l) of thiosulfate ion per liter.

Silver halide grains having a high silver chloride content constituting the photographic emulsions of the photographic material for processing in the present invention include silver chlorobromide, silver iodobromide or silver iodochlorobromide grains having a silver chloride content of at least 90 mol % (as a mean value), or silver chloride grains. The silver iodide content is preferably not higher than 1 mol %. Particularly preferred is silver chlorobromide having a silver chloride content of at least 96 mol % (as a mean value) or silver chloride.

The silver halide grains contained in high silver chloride content emulsion for use in the present invention preferably comprise a localized silver bromide phase (or layer) having a relatively high silver bromide content in comparison with the silver bromide content of the substrate grain (i.e., of the other silver halide grains).

In a preferred embodiment of such a localized silver bromide layer structure, the silver halide grains comprise a localized silver bromide phase on the surfaces of the grains or in the vicinity of the surfaces of the grains. Silver halide grains having protruding localized silver bromide phases on the edges or corners of the surfaces of the crystals or on the planes of the crystals are particularly preferred. The localized silver halide phase has a silver bromide content of from 10 mol % to 95 mol %. The silver bromide content is preferably from 15 mol % to 90 mol %, more preferably from 20 mol % to 60 mol %, and most preferably from 30 mol % to 60 mol %.

The remainder of the silver halide in the localized silver bromide phase is silver chloride. The localized silver bromide phase preferably contains a very small amount of silver iodide not exceeding 1 mol % (particularly 0.3 mol % or less) based on the total silver halide content of the silver halide emulsion as described above.

Furthermore, the localized silver bromide phase preferably occupies from 0.03 mol % to 10 mol %, particularly from 0.1 mol % to 10 mol % of the entire amount of silver halide constituting the silver halide grains contained in the emulsion.

The localized silver bromide phase need not be of a single halogen composition, and may comprise two or more localized phases each having a different silver bromide content. The halogen composition may continuously vary at the interface between the localized silver bromide phase and other phases (i.e., the change in silver halide composition between different phases need not be an abrupt change).

The above-described localized silver bromide phase can be formed, for example, by reacting a previously formed emulsion comprising silver chloride or high silver chloride content grains with a water-soluble silver salt and a water soluble halide containing a water-soluble bromide by the double jet method to deposit a localized silver bromide phase on the grains; by converting a part of the silver chloride or high silver chloride content grains previously formed to a silver bromide rich phase using a halogen conversion method; or by adding fine silver bromide or high silver bromide content grains (having a finer grain size than that of the base silver chloride or high silver chloride content grains) and another sparingly soluble silver salt to silver chloride or high silver chloride content grains to recrystallize silver bromide on the surfaces of the silver chloride or high silver chloride content base grains, to thereby form a localized silver bromide phase.

A useful method for forming a localized silver bromide phase on high silver chloride content grains is described in European Patent (Laid-Open) No. 0,273,430A2.

The silver bromide content of the silver bromide localized phase can be analyzed by X-ray diffractometry [e.g., as described in Shinjikken Kagaku Koza 6, Kozo Kaiseki (written in Japanese), edited by Nippon Kagaku Kai, published by Maruzen, Japan] or an XPS method [e.g., as described in "Surface Analysis, -IMA, Application of O. J. electron, photoelectron spectroscopy (written in Japanese), published by Kodansha, Japan]. Furthermore, the localized silver bromide phase can be observed through an electron microscope, or can be analyzed by the method described in European Patent (Laid Open) No. 0,273,430A2.

Of these methods, the method wherein silver bromide and/or silver chlorobromide are formed on the surfaces of high silver chloride content grains in the emulsion during chemical ripening is particularly useful for forming the high silver bromide content layer (i.e., localized silver bromide phase) in the present invention. This method is preferred for obtaining high sensitivity and reducing fog.

The effects of the invention under various processing conditions are enhanced by incorporating into the silver halide grains for use in the present invention metal ions other than silver ion (e.g., one or more metal ions selected from metals of Group VIII, transition metals of Group II, lead of Group IV, metals of Group I, in the Periodic Table and copper) or complex ions thereof. These metal ions or complex ions may be uniformly incorporated into the silver halide grains, or into the above described localized silver bromide phase alone, or into other phases.

Of these metal ions or complex ions thereof, metal ions selected from the group consisting of iridium ion, palladium ion, rhodium ion, zinc ion, iron ion, platinum ion, gold ion and copper ion are particularly useful. When these metal ions or complex ions are used in combination rather than alone, desirable photographic characteristics can often be obtained. Preferably, different metal ion species and addition amounts thereof are added to the localized silver bromide phase as opposed to other portions of the silver halide grains. Iridium ion or rhodium ion are particularly preferably incorporated into the localized silver bromide phase.

The metal ions or the complex ions thereof can be introduced into the localized silver bromide phases of the silver halide grains and/or other portions of the grains by directly adding them to a reaction vessel during physical ripening before, during or after the formation of the silver halide grains; or by adding the metal ions or complex ions thereof to an aqueous solution of a water-soluble halide or a water-soluble silver salt which are reacted to form the silver halide grains. When the localized silver bromide phases are formed by using fine silver bromide or high silver bromide content grains, the metal ions or the complex ions can be incorporated into the silver bromide fine grains or high silver bromide content fine grains in the same manner as described above, and then the obtained fine grains containing the metal ions or complex ions thereof are added to a silver chloride or high silver chloride content emulsion. The metal ions or the complex ions may be introduced into the localized silver bromide phases by adding sparingly soluble bromides of the above metal ions in the form of a solid or powder while forming the localized phases.

The silver halide emulsion for use in the present invention preferably contains at least 50 wt %, more preferably at least 60 wt %, particularly preferably at least 80 wt % of cubic silver halide grains having a (100) face/(111) face ratio of at least 5, preferably at least 10, though there is no particular restriction with regard to this ratio. Silver halide emulsions containing at least 50 wt % of octahedral or platy (tabular) silver halide grains having a (100) face/(111) face ratio of less than 5, more preferably less than 0.5, most preferably 0 to less than 0.5 can also be used in the present invention.

The silver halide grains for use in the present invention have a grain size of from 0.1 to 0.4 μm, preferably from 0.1 to 0.35 μm, more preferably from 0.1 to 0.3 μm.

Grains having a smaller size are preferred for obtaining high covering power, and the silver/binder ratio can also be reduced.

The grain size distribution of the silver halide grains may be wide or narrow. However, monodispersed emulsions are preferred for providing enhanced photographic characteristics such as latent image stability, pressure resistance, etc., and for promoting improved processing stability, such as less variation in photographic characteristics with a change in developing solution pH, etc. The value S/d obtained by dividing the standard deviation S in grain size distribution by the mean grain size (the diameter of the silver halide grain is defined as the diameter of a circle having an area equal to the projected area of the grain, and the mean value of the diameters is referred to as the mean grain size) is preferably 20% or less, more preferably 15% or less.

Silver chloride emulsions, silver chlorobromide emulsions or silver chloroiodobromide emulsions for use in the present invention can be prepared by using the methods described, e.g., in P. Glafkides, *Chimie et Phisique Photographique* (Paul Montel 1967), G. F. Duffin, *Photographic Emulsion Chemistry* (Focal Press 1966), and V. L. Zelikman et al., *Making and Coating Photographic Emulsion* (Focal Press 1964). Namely, any of the acid process, neutral process and ammonia process can be used in the present invention. However, the acid process and the neutral process are particularly preferred for reducing fog. A soluble silver salt and a soluble halide can be reacted by any of the single jet process, the double jet process and a combination thereof to obtain the silver halide emulsions. A reverse mixing method wherein grains are formed in the presence of excess silver ion can be used. The double jet process is preferred for obtaining monodispersed grain emulsions preferably used in the present invention. A controlled double jet process wherein the concentration of silver ion in the liquid phase, in which silver halide is formed, is maintained constant is more preferred. Using this method, a silver halide emulsion having a regular crystal form and a narrow grain size distribution can be obtained, which is preferred in the present invention.

A method using a bispyridinium compound as described in JP-A-2-32 (the term "JP-A" as used herein means an "unexamined published Japanese patent application"), JP-A-3-137632, JP-A-4-6546, Japanese Patent Application Nos. 3-36632 and 3-236880, and methods described in JP-A-63-293536, JP-A-1-155332, JP-A-63-2043, JP-A63-25643 and U.S. Pat. Nos. 4,400,463 and 5,061,617, are preferably used to form high silver chloride content grains having the above-described face ratio for use in the present invention.

A cadmium salt, a zinc salt, a lead salt, a thallium salt, an iridium salt or a complex salt thereof, a rhodium salt or a complex salt thereof, or an iron salt or a complex salt thereof may be present during formation of the above silver halide grains or during the physical ripening thereof.

Silver halide solvents (e.g., conventional solvents, such as ammonia, thiocyanates, or thioethers or thione compounds described in U.S. Pat. No. 3,271,157, JP-A-51-12360, JP-A-53-82408, JP-A-53-144319, JP-A-54-100717 or JP-A-54-155828) may be used during or after formation of the grains. When these solvents are used in combination with the above-described methods, silver halide emulsions having a regular crystal form and narrow grain size can be obtained which is preferred in the present invention.

Soluble salts can be removed form the emulsions after physical ripening by noodle washing, a flocculation precipitation method or ultrafiltration.

The emulsions for use in the present invention can be chemical-sensitized by sulfur sensitization, selenium sensitization, reduction sensitization or noble metal sensitization alone or in combination thereof. Namely, sulfur sensitization methods using compounds containing a sulfur compound capable of reacting with active gelatin or silver ion (e.g., thiosulfates, thiourea compounds, mercapto compounds, rhodanine compounds), reduction sensitization methods using reducible materials (e.g., stannous salts, amines, hydrazine derivatives, formamidinesulfinic acid, silane compounds), and noble metal sensitization methods using metallic compounds (e.g., gold complex salts or salts of Group VIII metals such as platinum, iridium, palladium, rhodium and iron or complex salts thereof) can be used alone or in combination. Sulfur sensitization or selenium sensitization is preferred for the emulsions for use in the present invention. Sulfur sensitization or selenium sensitization is preferably used in combination with gold sensitization. Furthermore, in order to control sensitivity and gradation, chemical sensitization is preferably carried out in the presence of a hydroxyazaindene compound or nucleic acid.

Preferred spectral sensitizing dyes for use in the present invention include those having a wavelength sensitivity in the range of at least 600 nm as described in JP-A-3-11336, JP-A-64-40939, JP-A-4-324855, JP-A-5-45833, Japanese Patent Application Nos. 2-266934, 3-6632, 3-266959 and 3-311498.

These sensitizing dyes may be used either alone or in combination. A combination of the sensitizing dyes is often used for the purpose of supersensitization. In addition to the sensitizing dyes, the emulsions may contain a dye which itself does not have a spectral sensitizing effect, or a substance which does substantially not absorb visible light, but has a supersensitizing effect.

Examples of useful sensitizing dyes, combinations of the sensitizing dyes for supersensitization and the substances having a supersensitizing effect are described in *Research Disclosure* 176, No. 17643 (December 1978), page 23, Item IV-J, JP-B-49-25500 (the term "JP-B" as used herein means an "examined Japanese patent publication"), JP-B-43-4933, JP-A-59-19032 and JP-A-59-192242.

The optimum amount of the spectral sensitizing dye having a wavelength sensitivity of at least 600 nm preferably used in the present invention depends on the grain sizes of the silver halide grains contained in the emulsions, the halogen compositions of the grains, the type and degree of chemical sensitization, the relationship between the layer to which the sensitizing dye is added and the silver halide emulsion, the type of anti-fogging agents, etc. The optimum addition amount of the spectral sensitizing dye can readily be experimentally determined by those skilled in the art. Generally, the spectral sensitizing agents are used in an amount of preferably $1\times10^{-7}$ to $1\times10^{-2}$ mol, particularly preferably $1\times10^{-6}$ to $5\times10^{-3}$ mol per mol of silver halide.

The photographic material of the present invention may contain various compounds to prevent fogging during the preparation, storage or processing of the photographic material or to stabilize photographic performance. Examples of compounds known as anti-fogging agents or stabilizers which may be contained in the photographic material include azoles such as benzthiazolium salt, nitroindazoles, chlorobenzimidazoles, bromobenzimidazoles, mercaptotetrazoles, mercaptothiazoles, mercaptobenzthiazoles, mercaptothiadiazoles, aminotriazoles, benzthiazoles and nitrobenztriazoles; mercaptopyrimidines; mercaptotriazines; thioketo compounds such as oxazolinethione; azaindenes such as triazaindenes, tetraazaindenes (particularly 4-hydroxy-substituted (1,3,3a,7)-tetrazaindenes) and pentaazaindenes; benzenethiosulfonic acid and benzenesulfinic acid; and benzenesulfonic acid amide. Of these compounds, benztriazoles (e.g., 5-methylbenztriazole) and nitroindazoles (e.g., 5-nitroindazole) are preferred. These compounds may also be added to the processing solutions. Further, compounds which release a development inhibitor during development as described in JP-A-62-30243 may be added to the processing solution to serve as stabilizers.

The photographic material of the present invention may contain a developing agent such as a hydroquinone derivative and a phenidone derivative to serve as stabilizers and accelerators.

The photographic emulsion layers and other hydrophilic colloid layers of the photographic material of the present invention may contain an inorganic or organic hardening agent. Examples of the inorganic or organic hardening agents include chromium salts (e.g., chromium alum, chromium acetate), aldehydes (e.g., formaldehyde, glutaraldehyde), N-methylol compounds (e.g., dimethylol urea), dioxane derivative, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) and mucohalogenic acids (e.g., mucochloric acid). These compounds may be used either alone or in combination of two or more thereof.

The hydrophilic colloid layers of the black-and-white photographic material of the present invention may contain water-soluble dyes as filter dyes, or to prevent irradiation, etc. Examples of water-soluble dyes useful in the present invention include oxonol dyes, hemioxonol dyes, styryl dyes, merocyanine dyes, cyanine dyes and azo dyes. Particularly, oxonol dyes, hemioxonol dyes and merocyanine dyes are preferred.

The support for the photographic material of the present invention which is a transparent base preferably has a thickness of 150 to 250 μm to promote handleability when observation is made on medical light table. Polyethylene terephthalate film is preferred as a material for the support. Blue-colored material is particularly preferred.

The surfaces of the support are preferably subjected to corona discharge treatment, glow discharge treatment or ultraviolet light irradiation treatment to improve adhesion between the support and an adjoining hydrophilic colloid layer. Alternatively, a subbing layer comprising a styrene-butadiene latex or a vinylidene chloride latex may be provided on the surface of the support. Furthermore, a gelatin layer may be provided thereon.

A subbing layer may be provided by using an organic solvent containing a polyethylene swelling agent and gelatin as a coating liquid.

When the subbing layer is subjected to surface treatment, the adhesion between the support and the hydrophilic colloid layer can be further improved.

The total gelatin coating weight on the silver halide emulsion layer side of the support in the present invention is preferably 3.5 g/m$^2$ or less, more preferably 3.3 g/m$^2$ or less, most preferably 1.5 to 3.0 g/m$^2$.

The entire coating weight of the silver halide emulsion per one side of the support in the present invention is preferably not more than 2.6 g/m$^2$, more preferably not more than 2.3 g/m$^2$, most preferably 1.0 g/m$^2$ to 2.0 g/m$^2$ in terms of silver.

The ratio by weight of silver to gelatin in the silver halide emulsion layer is an important factor from the standpoint of rapid processability. For processing in an automatic processor, when the ratio of silver to gelatin in the silver halide emulsion layer is increased, emulsion pick-off occurs where the emulsion layer is peeled off by protrusions on the rollers so that an image is hardly observed. In view of the above, the ratio by weight of silver to gelatin in the silver halide emulsion layer is preferably 1.4 or less, more preferably 1.2 or less, most preferably 0.5 to 1.1.

Additives, methods and layer structures described in the following patent specifications can be used to prepare the photographic material of the present invention.

| Item | Places |
|---|---|
| (1) Chemical sensitization method | The 13th line of right upper column to the 16th line of left upper column of page 10 of JP-A-2-68539; and Japanese Patent Application No. 3-105035. |
| (2) Anti-fogging agent, stabilizer | The 17th line of left lower column of page 10 to the 7th line of left upper column of page 11 of JP-A-2-68539; and the second line of left lower column of page 3 to left lower column of page 4 of JP-A-2-68539. |
| (3) Color tone improver | The 7th line of left lower column of page 2 to the 20th line of left lower column of page 10 of JP-A-62-276539; and the 15th line of left lower column of page 6 to the 19th line of right upper column of page 11 of JP-A-3-94249. |
| (4) Surfactant, antistatic agent | The 14th line of left upper column of page 11 to the 9th line of left upper column of page 12 of JP-A-2-68538. |
| 5) Matting agent, lubricant (sliding agent), plasticizer | The 10th line of left upper column to the 10th line of right upper column of page 12 of JP-A-2-68539; and the 10th line of left lower column to the first line of right lower column of page 14 of JP-A-2-68539. |
| (6) Hydrophilic colloid | The 11th line of right upper column to the 16th line of left lower column of page 12 of JP-A-2-68539. |
| (7) Hardening agent | The 17th line of left lower column of page 12 to the 6th line of right upper column of page 13 of JP-A-2-68539. |
| (8) Polyhydroxybenzenes | Left upper column of page 11 to left lower column of page 12 of JP-A-3-39948; and EP 452,772A. |
| (9) Layer structure | JP-A-3-198041 |

The developing bath comprises sodium ion in amount comprising at least 70 mol %, preferably at least 80 mol % and more preferably at least 85 mol % but not more than 100 mol % of the entire cation content of developing bath.

A preferred developing agent for use in the developing bath of the present invention is a dihydroxybenzene developing agent. Examples of the dihydroxybenzene developing agent include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5 dimethylhydroquinone and hydroquinonemonosulfonic acid. Of these compounds, hydroquinone is particularly preferred. The developing agent is generally used in an amount of from 0.05 to 0.8 mol/l.

In the present invention, the dihydroxybenzene developing agent is preferably used together with a 1-phenyl-3-pyrazolidone compound or p-aminophenol compound.

Examples of the 1-phenyl-3-pyrazolidone compound include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone and 1-phenyl-5-methyl-3-pyrazolidone.

Examples of the p-aminophenol compound include N-methyl-p-aminophenol, N-(8-hydroxyethyl)-p-aminophenol, N-(4-hydroxyphenyl)glycine, 2-methyl-p-aminophenol and p-benzylaminophenol. Particularly, N-methyl-p-aminophenol is preferred.

When the dihydroxybenzene developing agent is used in combination with an auxiliary developing agent such as a 1-phenyl-3-pyrazolidone compound or a p-aminophenol compound, the former is used in an amount of preferably 0.05 to 0.5 mol/l, and the latter is used in an amount of preferably 0.001 to 0.06 mol/l, particularly preferably 0.003 to 0.06 mol/l.

Examples of sulfites for use in the developing bath of the present invention include sodium sulfite, potassium sulfite, lithium sulfite, ammonium sulfite, sodium bisulfite, potassium metabisulfite and formaldehyde-sodium bisulfite adduct. The sulfite is used in an amount of preferably at least 0.10 mol/l, particularly preferably at least 0.20 mol/l. The upper limit is preferably 2.5 mol/l, particularly preferably 1.2 mol/l.

The developing bath for use in the present invention may contain an amino compound to accelerate development. The amino compounds described in JP-A-56-106244, JP-A-61-267759 and JP-A-2-208652 may be used.

The pH value of the developing bath for use in the present invention is preferably 10.0 or lower, particularly preferably 8.0 to 9.8. Alkali agents which can be used to adjust the pH value of the developing bath include conventional water-soluble inorganic alkali metal salts such as sodium hydroxide and sodium carbonate.

In addition to the above-described compounds, the developing bath for use in the present invention may contain a pH buffering agent such as boric acid, borax, sodium secondary phosphate, potassium secondary phosphate, sodium primary phosphate and potassium primary phosphate and the pH buffering agents described in JP-A-60-93433; a development inhibitor such as potassium bromide and potassium iodide; an organic solvent such as dimethylformamide, methyl cellosolve, hexylene glycol, ethanol and methanol; and a benzotriazole derivative such as 5-methylbenzotriazole, 5-bromobenzotriazole, 5-chlorobenzotriazole, 5-butylbenzotriazole and benzotriazole (particularly preferably 5-methylbenzotriazole), and a nitroindazole compound such as 5-nitroindazole, 6-nitroindazole, 4-nitroindazole, 7-nitroindazole and 3-cyano-5-nitroindazole (particularly preferably 5-nitroindazole). When the developer contains a 5-nitroindazole, the developer is prepared by separately dissolving a portion containing a dihydroxybenzene developing agent and another portion containing a bisulfite preservative. When used, both portions are mixed together and water is added thereto. When the portion containing the dissolved 5-nitroindazole is alkalized, the portion is colored yellowed for convenience of handling.

Furthermore, the developing solution may contain a color toning agent, a surfactant, a hard water softener and a hardening agent.

Useful chelating agents for addition to the developing solution include ethylenediaminedi-o-hydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, trans-cyclohexanediaminetetraacetic acid, ethylenediaminetetraacetic acid, glycol ether diaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,5-disulfonic acid, sodium pyrophosphate, sodium tetrapolyphosphate and sodium hexametaphosphate. Of these compounds, diethylenetriaminepentaacetic acid, triethylenetetraminehexaacetic acid, 1,3-diaminopropanoltetraacetic acid, glycol ether diaminetetraacetic acid, hydroxyethylethylenediaminetriacetic acid, 2-phosphonobutane-1,2,4-tricarboxylic acid, 1,1-diphoshonoethane-2-carboxylic acid, nitrilotrimethylenephosphonic acid, ethylenediaminotetraphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid and salts thereof are particularly preferred.

The chelating agent of the present invention is added to the developing solution in an amount of preferably $5\times10^{-4}$ mol/l to $1\times10^{-1}$ mol/l and more preferably $1\times10^{-3}$ mol/l to $1\times10^{-2}$ mol/l.

The developing bath for use in the present invention may contain the compounds described in JP-B- 62-4702, JP-B-62-4703, JP-A-1-200249 and Japanese Patent Application Nos. 3-94955, 3-112275 and 3-233718 to prevent the occurrence of silver stain.

Furthermore, the developing bath for use in the present invention may contain a dialdehyde hardening agent and a dialdehyde-bisulfite adduct. Specific examples of useful dialdehyde hardening agents and adducts include glutaric aldehyde, α-methylglutaric aldehyde, β-methylglutaric aldehyde, maleindialdehyde, succindialdehyde, methoxysuccindialdehyde, methylsuccindialdehyde, α-methoxy-β-ethoxy-glutaric aldehyde, α-n-butoxyglutaric aldehyde, α,α-dimethoxysuccindialdehyde, β-isopropylsuccindialdehyde, α,α-diethylsuccindialdehyde, butylmaleindialdehyde and bisulfite adducts thereof. The dialdehyde compounds are used in such amount that the sensitivity of the photographic layers is not inhibited and the drying time is not prolonged. More specifically, the dialdehyde compounds are used in an amount of generally 1 to 50 g, preferably 3 to 10 g per liter of the developing bath. Glutaric aldehyde or bisulfite adduct thereof is generally used.

When a bisulfite adduct of a dialdehyde hardening agent is used, the bisulfite in the adduct is calculated as part of the sulfite in the developing solution.

Furthermore, the additives described in L. F. A. Mayson, *Photographic Processing Chemistry* (Focal Press 1966), pp. 226 to 229, U.S. Pat. Nos. 2,193,015 and 2,592,364 and JP-A-48-64933 may be used.

Processing is carried out in the present invention while replenishing the developing bath (or solution) in an amount of generally not more than 150 ml, particularly 50 to 150 ml per $m^2$ of the photographic material processed.

The developing solution introduced into the development tank of the automatic processor at the time of the commencement of development may be a developing solution having a composition described above, or a solution wherein a part of the above described composition is varied.

The fixing bath (or solution) for use in the present invention is an aqueous solution containing thiosulfate, and has a pH of generally at least 3.8, preferably 4.2 to 6.0.

Examples of useful fixing agents include sodium thiosulfate and ammonium thiosulfate. The addition amount of the fixing agent can be appropriately selected, but is generally about 0.1 to about 3 mol/l.

The fixing bath may contain a water-soluble aluminum salt which functions as a hardening agent. Examples of the water-soluble aluminum salt include aluminum chloride, aluminum sulfate and potash alum.

The fixing bath may contain tartaric acid, citric acid, gluconic acid and derivatives thereof. These compounds may be used either alone or as a mixture of two or more thereof. These compounds are effectively used in an amount of at least 0.005 mol, particularly 0.01 to 0.03 mol/liter of the fixing bath.

If desired, the fixing solution may contain a preservative (e.g., a sulfite or bisulfite), a pH buffering agent (e.g., acetic acid, boric acid), a pH adjustor (e.g., sulfuric acid), a chelating agent having the ability to soften hard-water, and compounds described in JP-A-62-78551.

Processing is carried out in the present invention while replenishing the fixing bath in an amount of generally not more than 150 ml, particularly 50 to 150 ml per $m^2$ of the photographic material processed.

In the processing of the present invention, the photographic material is treated with rinsing water or a stabilizing solution after the development and fixing stages, and then dried.

Examples of automatic processors for use in the present invention include various types of automatic processors such as roller conveying type and belt conveying type processors. However, roller conveying type automatic processors are preferred. Particularly, when automatic processors with development tanks having a small opening ratio as described in JP-A-1-166040 and JP-A 1-193853 are used, oxidation by air and evaporation can be reduced, stable operation is provided under safe environmental conditions, and replenishment rates can be further reduced.

Multi-stage countercurrent systems (e.g., two-stage, three-stage) are well known as a means for reducing the replenishment rate of rinsing water. When a multi-stage countercurrent system is applied to the processing method of the present invention, rinsing is more efficiently accomplished. This is because the photographic material after fixing is processed in progressively cleaner rinse tanks, that is, the photographic material is brought into contact in the later processing stages with processing solutions which are not contaminated by the fixing solution.

An antifungal means for rinsing water or the stabilizing solution is preferably provided in the above-described water-saving system or non-piping system.

Examples of the antifungal means include an ultraviolet light irradiation method as described in JP-A-60-26393; a method using a magnetic field as described in JP-A-60-263940; a method wherein water is purified by using an ion exchange resin as described in JP-A-131632; and a method using antimicrobial agents as described in JP-A-61-115154, JP-A-62-153952, JP-A-62-220951 and JP-A-62-209532.

Furthermore, antimicrobial agents, antifungal agents and the surfactants described in L. F. West, "Water Quality Criteria" Photo. Sci. & Eng. Vol. 9 No. 6 (1965), M. W. Beach, "Microbiological Growths in Motionpicture Processing" SMPTE Journal Vol. 8.5, (1976), R. D. Deegan, "Photo Processing Wash Water Biocides" J. Imaging Tech 10, No. 6 (1984), JP-A-57-8542, JP-A-57-58143, JP-A-58-105145, JP-A-57-132146, JP-A-58-18631, JP-A-57-97530 and JP-A-57-157244 may be used in combination.

Furthermore, the isothiazoline compounds described in R. T. Kreiman, *J. Image Tech* 10 (6), page 42 (1984); the isothiazoline compounds described in *Research Disclosure.* Vol. 205, No. 20526 (May 1981); the isothiazoline compounds described in *Research Disclosure,* Vol. 228, No. 22845 (April 1983); and the compounds described in JP-A-62-209532 can be used as microbiocides in combination with the above-described compounds.

In addition thereto, the compounds described in *Antimicrobial Antifungal Chemistry,* written by Hiroshi Horiguchi published by Sankyo Shuppan (1982) (written in Japanese) and *Antimicrobial Antifungal Technical Handbook,* edited by Nippon Bokin Bobai Gakkai, published by Hakuhodo (1986) (written in Japanese) may be used.

When rinsing is carried out with a small amount of rinsing water in the method of the present invention, a squeeze roller washing tank as described in JP-A-63-18350 is preferably provided. Furthermore, a rinsing stage as described in JP-A-63-143548 is preferably used.

Furthermore, a part or all of the overflow solution from the rinsing bath or the stabilizing bath can be reused for the processing solution having a fixing ability in a prestage as described in JP-A-60-235133, in which overflow solution is produced by replenishing the rinsing bath or the stabilizing bath with water treated with the antifungal means in the method of the present invention.

The term "development stage time" or "development time" as used herein means the time from when the top edge of the photographic material is immersed into the developing bath of an automatic processor to the time when that same edge is immersed into the fixing bath. The term "fixing time" as used herein means the time from when the top edge of the photographic material is immersed into the fixing bath to the time when that same edge is immersed into a rinsing bath or stabilizing bath. The term "rinsing time" as used herein means the time in which the photographic material is immersed in the rinsing solution (or stabilizing solution) in the rinsing tank. The term "drying time" as used herein means the time during which the photographic material is placed in the drying zone of the automatic processor. Usually, the automatic processor is provided with a drying zone where hot air heated to generally 35 to 100° C., preferably 40° to 80° C. is blown.

In the processing of the present invention, the development time is preferably from 5 seconds to one minute, more preferably from 8 seconds to 30 seconds, and the development temperature is preferably 18° to 50° C., more preferably 20° to 40° C.

According to the present invention, the fixing temperature and time are preferably about 18 to about 50° C. for 5 seconds to one minute, more preferably 20° to 40° C. for 6 to 30 seconds. When fixing is carried out within the above range, fixing is satisfactorily carried out, and the sensitizing dyes can be dissolved out of the photographic material so as not to leave residual color.

The rinsing (stabilizing) temperature and time are preferably 0° to 50° C. for 6 seconds to one minute, more preferably 15° to 40° C. for 6 to 30 seconds.

According to the method of the present invention, rinsing water is squeezed from the photographic material after development, fixing and rinsing (or stabilization). Namely, the photographic material is dried through squeeze rollers. Drying is carried out at a temperature of about 40° to about 100° C. The drying time can be appropriately selected depending on environmental conditions, but is usually about 5 seconds to one minute, particularly preferably about 5 to 30 seconds at a temperature of 40° to 80° C.

When processing is carried out in a period of generally 100 seconds or less (preferably 20 to 100 seconds) with Dry to Dry time in the photographic material processing system of the present invention, in order to prevent uneven development unique to rapid processing, rubber rollers as described in JP-A-63-151943 are preferably provided at the outlet of the development tank; the discharging flow rate is set to at least 10 m/min to stir the developing solution in the development tank as described in JP-A-63-151944; or the stirring intensity is increased during operation from a stand-by state as described in JP-A-63-264758. Furthermore, the rollers in the fixing solution tank are preferably opposed rollers to expedite the fixing rate in rapid processing. When opposed rollers are used, the number of rollers can be decreased and the capacity of the processing tank can be reduced. Namely, the automatic processors can be made more compacted.

The present invention is now illustrated in greater detail by reference to the following examples which, however, are not to be construed as limiting the invention in any way.

EXAMPLE 1

1. Preparation of Silver Halide Emulsion A 32 g of gelatin was dissolved in 900 ml of distilled water at 40° C. The pH of the resulting aqueous solution was adjusted with sulfuric acid to 3.8, and 3.3 g of sodium chloride was added thereto. To the obtained solution, a solution of 32 g of silver nitrate dissolved in 200 ml of distilled water and a solution of 11 g of sodium chloride and 0.02 mg of $K_2IrCl_6$ dissolved in 200 ml of distilled water were added at 40° C. over a period of 2 minutes. Furthermore, a solution of 64 g of silver nitrate dissolved in 280 ml of distilled water and a solution of 21.6 g of sodium chloride dissolved in 275 ml of distilled water were added thereto at 40° C. over a period of 5 minutes. Subsequently, a solution of 64 g of silver nitrate dissolved in 280 ml of distilled water and a solution of 22.4 g of sodium chloride and 0.04 g of $K_4Fe(CN)_6 \cdot 3H_2O$ dissolved in 285 ml of distilled water were added thereto at 40° C. over a period of 5 minutes.

The thus-obtained emulsion was observed through an electron microscope, and was found to be an emulsion comprising cubic grains having an average side length of about 0.21 μm and a coefficient of variation in grain size distribution of 9.8%.

Preparation of Silver Halide Emulsions B, C. and D

Silver halide emulsions B, C. and D were prepared in the same manner as silver halide emulsion A, except that sodium chloride and potassium bromide were used in place of sodium chloride alone, the amounts thereof were adjusted and the grain forming temperature was changed to obtain the emulsions having the halogen compositions shown in Table 1 below.

TABLE 1

| Photographic material | Emulsion | Halogen Composition |
|---|---|---|
| 1 (Invention) | A | Cl = 99 mol % (Br 1 mol %) |
| 2 (Invention) | B | Cl = 91.9 mol % (Br 8.1 mol %) |
| 3 (Comparison) | C | Cl = 60 mol % (Br 40 mol %) |
| 4 (Comparison) | D | Cl = 30 mol % (Br 70 mol %) |

After each emulsion was desalted, 72 g of gelatin and 2.6 g of phenoxyethanol were added thereto. The pH of the emulsion was adjusted to 6.7, and the pAg thereof was adjusted with NaCl to 7.9. The emulsion was then chemical-sensitized at 58° C. in the following manner. First, one mol % (in terms of silver halide) of a monodispersed silver bromide emulsion having a mean grain size of 0.05 μm was added thereto. Subsequently, 7.2 mg of the following compound (1), 9.2 mg of chloroauric acid, 1.3 mg of triethylthiourea and 0.72 mg of the following selenium sensitizing agent (A) were added thereto. Furthermore, 0.29 g of nucleic acid was added thereto. Finally, 162 mg of 4-hydroxy-6-methyl-1,3,3a,7-tetrazaindene was added thereto. The emulsion was quenched to solidify the same, to thereby prepare each of the emulsions A, B, C. and D.

Compound (1)

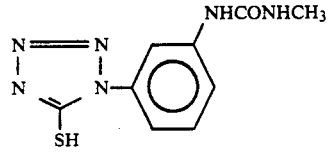

Selenium Sensitizing Agent (A)

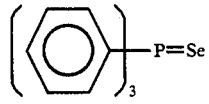

2. Preparation of Emulsion Coating Solution

The following reagents were added to the emulsion A to prepare an emulsion coating solution, each amount being per mol of silver halide.

Formulation of Emulsion Coating Solution

| | |
|---|---|
| Spectral Sensitizing Dye [2] | $5.5 \times 10^{-5}$ mol |
| Supersensitizing Agent [3] | $3.3 \times 10^{-4}$ mol |
| Polyacrylamide (M.W. = 40,000) | 9.2 g |
| Trimethylol Propane | 1.4 g |
| Latex of Poly(ethyl acrylate/methacrylic acid) | 22 g |

Spectral Sensitizing Dye [2]

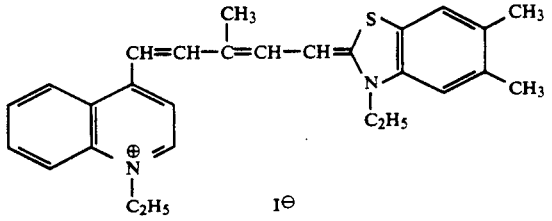

Supersensitizing Agent [3]

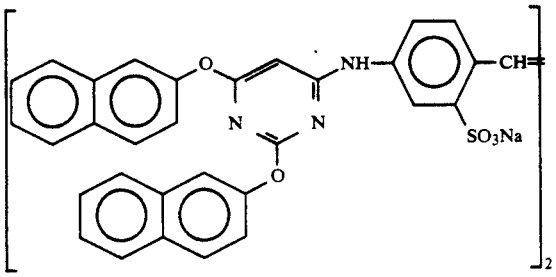

3. Preparation of Coating Solution for Surface Protective Layer for Emulsion Layer A container was heated to 40° C., and the following reagents were added thereto to prepare a coating solution.

| | |
|---|---|
| Gelatin | 100 g |
| Polyacrylamide (M.W. = 40,000) | 12.3 g |
| Polysodium Styrenesulfonate (M.W. = 600,000) | 0.6 g |
| Fine particles of Polymethyl Methacrylate (average particle size: 2.5 μm) | 2.7 g |
| Polysodium acrylate | 3.7 g |
| Sodium of t-Octylphenoxyethoxyethanesulfonate | 1.5 g |
| $C_{16}H_{33}O-(CH_2CH_2O)_{10}-H$ | 3.3 g |
| $C_8F_{17}SO_3K$ | 84 mg |
| $C_8F_{17}SO_2N(C_3H_7)(CH_2CH_2O)_4(CH_2)_4-SO_3Na$ | 84 mg |
| NaOH | 0.2 g |
| Methanol | 78 ml |
| 1,2-Bis(vinylsulfonylacetamide)ethane used in such an amount as to provide 2.5 wt % based on the total amount of gelatin used in the emulsion layer and the surface protective layer | |
| Compound (5) | 52 mg |

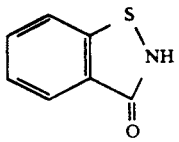

4. Preparation of Coating Solution for Back Layer

A container was heated to 40° C., and the following reagents were added thereto to prepare a coating solution.

| | |
|---|---|
| Gelatin | 100 g |
| Dye (A) | 2.38 g |

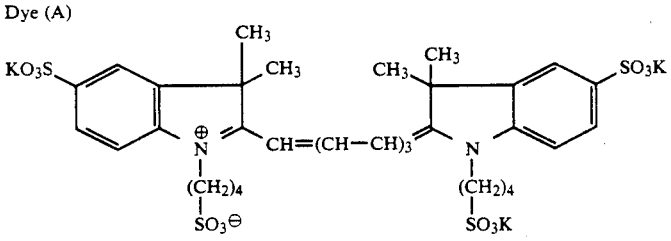

| | |
|---|---|
| Polysodium styrenesulfonate | 1.1 g |
| Phosphoric acid | 0.55 g |
| Poly(ethyl acrylate/methacrylic acid) Latex | 2.9 g |
| Compound (5) | 46 mg |
| Oil Dispersion of Dye (B) described in JP-A-61-285445 (in terms of the dye content of the dispersion) | 246 mg |
| Dye (B) | 46 mg |

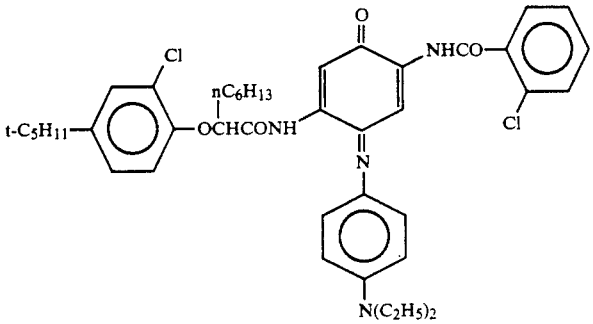

Dispersion of Dye (C) in the oligomer surfactant described in JP-A-62-275639

-continued (in terms of the dye content of the dispersion)
Dye (C)

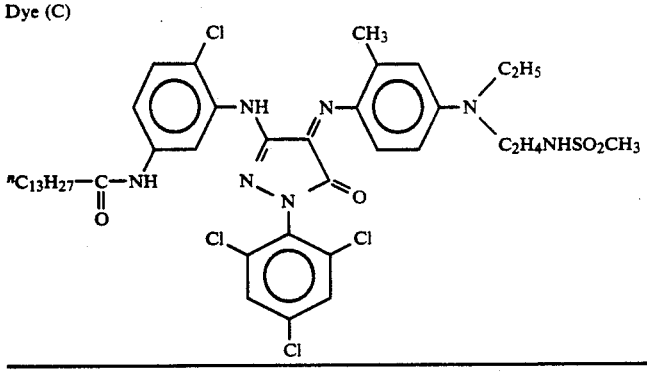

5. Preparation of Coating Solution for Surface Protective Layer for Back Layer

A container was heated to 40° C., and the following reagents were added thereto to prepare a coating solution.

| | |
|---|---|
| Gelatin | 100 g |
| Polysodium styrenesulfonate | 0.3 g |
| Fine particles of Polymethyl Methacrylate (average particle size: 3.5 (μm) | 4.3 g |
| Sodium t-Octylphenoxyethoxy-ethanesulfonate | 1.8 g |
| Polysodium Acrylate | 1.7 g |
| $C_{16}H_{33}O—(CH_2CH_2O)_{10}—H$ | 3.6 g |
| $C_8F_{17}SO_3K$ | 268 mg |
| $C_8F_{17}SO_2N(C_3H_7)(CH_2CH_2O)_4(CH_2)_4—SO_3Na$ | 45 mg |
| NaOH | 0.3 g |
| Methanol | 131 ml |
| 1,2-Bis(vinylsulfonylacetamide)ethane used in such an amount as to provide 2.2 wt% based on the total amount of gelatin used in the back layer and the surface protective layer | |
| Compound (5) | 45 mg |

6. Preparation of Photographic Material

The above coating solution for the back layer and the above coating solution for the surface protective layer for the back layer were coated on one side of blue-colored polyethylene terephthalate support. The gelatin coating weight of the back layer was 2.69 g/m$^2$, and the gelatin coating weight of the surface protective layer for the back layer was 1.13 g/m$^2$.

Subsequently, the above emulsion coating solution and the above coating solution for the surface protective layer for the emulsion layer were coated on the side of the support opposite to the above back layer to provide a coating weight of 1.85 g/m$^2$ in terms of silver. The gelatin coating weight of the emulsion layer was 1.6 g/m$^2$, and the gelatin coating weight of the surface protective layer was 1.23 g/m$^2$. Thus, a photographic material was prepared.

Developing Solution A

| | |
|---|---|
| Hydroquinone | 20.0 g |

-continued

| | |
|---|---|
| 1-Phenyl-4-methyl-4-hydroxymethyl-3-pyrazolidone | 2.0 g |
| Sodium Sulfite | 35.0 g |
| Sodium Carbonate Monohydrate | 25.0 g |
| Diethylenetriaminepentaacetic Acid | 2.0 g |
| Diethylene Glycol | 20.0 g |
| Boric Acid | 9.0 g |
| Potassium Bromide | 0.6 g |
| potassium Hydroxide | 2.0 g |
| Water to make | 1 liter |
| pH was adjusted to 9.50. | |

Developing Solution B

The developing solution B was prepared by adding 0.20 g of 5-methylbenztriazole to one liter of the developing solution A.

Developing Solution C

The developing solution C. was prepared by adding 0.15 g of 5-nitroindazole to one liter of the developing solution A.

Developing Solution D

The developing solution D was prepared by adding 0.10 g of 5-methylbenztriazole, 0.10 g of 2-mercaptoimidazole-5-sulfonic acid and 0.10 g of 2,3,5,6,7,8-hexahydro- 2-thioxo-4-(1H)-quinazolinone to one liter of the developing solution A.

Developing Solution E

The developing solution E was prepared by using 27.8 g of an equimolar amount of potassium carbonate in place of 25.0 g of sodium carbonate monohydrate used in the developing solution D.

Formulation of Fixing Solution

| | |
|---|---|
| Sodium Thiosulfate | 158 g (1.0 mol) |
| Sodium Bisulfite | 30 g |
| Disodium Ethylenediaminetetraacetate Dihydrate | 0.025 g |
| Diethylene Glycol | 40.0 g |
| Water to make | 1 liter |
| pH was adjusted with sodium hydroxide to 5.5. | |

The automatic processor used was FPM2000 (manufactured by Fuji Photo Film Co., Ltd.), wherein the rinsing tank thereof was modified to three baths. A conventional three-stage countercurrent system was used so that fresh rinsing water was fed to the rinsing bath closest to the outlet, and the overflow solution of rinsing water was fed to the previous rinsing bath in order. Furthermore, the driving shaft of the automatic processor was modified so that the conveying time of the film from introduction of the film until the film reached the drying outlet was 45 seconds. Rinsing water containing 0.2 g of disodium ethylenediaminetetraacetate dihydrate and 0.04 g of glutaric aldehyde was used, each amount being per liter of water.

Also, in the processing due to use of the above automatic processor, the development processing was carried out at 35° C. for 9 seconds, and the fixing processing was carried out at 32° C. for 9.6 seconds.

4 $m^2$ of the film was processed every day, and a three-week running test was carried out while the automatic processor was replenished with 400 ml (100 ml/$m^2$) of each of the developing solution, the fixing solution and rinsing water. The results obtained are shown in Table 2 below. The reciprocal of the exposure amount providing an optical density of (fog+1.0) is referred to herein as the sensitivity. The sensitivity is represented in terms of the relative sensitivity, where the sensitivity obtained by conducting the processing with the fresh developing solution A is referred to as 100. The fog shows the optical density of the unexposed area including the support.

TABLE 2

| Developing Solution | Na (mol %) of the Entire Cation Content of the Developer | Film | | Fresh Solution Sensitivity | Fresh Solution Fog | Fresh Solution Fixing Property | After 3-week running Sensitivity | After 3-week running Fog | After 3-week running Fixing Property |
|---|---|---|---|---|---|---|---|---|---|
| A | 96% | Emulsion A | Invention | 100 | 0.18 | 5 | 100 | 0.18 | 5 |
| " | " | Emulsion B | " | 100 | 0.18 | 5 | 100 | 0.18 | 5 |
| " | " | Emulsion C | Comparison | 110 | 0.17 | 5 | 110 | 0.17 | 3 |
| " | " | Emulsion D | " | 120 | 0.16 | 5 | 120 | 0.16 | 3 |
| B | 96% | Emulsion A | Invention | 90 | 0.15 | 5 | 90 | 0.15 | 5 |
| " | " | Emulsion B | " | 90 | 0.15 | 5 | 90 | 0.15 | 5 |
| " | " | Emulsion C | Comparison | 100 | 0.14 | 5 | 100 | 0.14 | 3 |
| " | " | Emulsion D | " | 110 | 0.13 | 5 | 110 | 0.13 | 3 |
| C | 96% | Emulsion A | Invention | 90 | 0.15 | 5 | 90 | 0.15 | 5 |
| " | " | Emulsion B | " | 90 | 0.15 | 5 | 90 | 0.15 | 5 |
| " | " | Emulsion C | Comparison | 100 | 0.14 | 5 | 100 | 0.14 | 3 |
| " | " | Emulsion D | " | 110 | 0.13 | 5 | 110 | 0.13 | 3 |
| D | 96% | Emulsion A | Invention | 90 | 0.15 | 5 | 90 | 0.15 | 5 |
| " | " | Emulsion B | " | 90 | 0.15 | 5 | 90 | 0.15 | 5 |
| " | " | Emulsion C | Comparison | 100 | 0.14 | 5 | 100 | 0.14 | 3 |
| D | 96% | Emulsion D | Comparison | 110 | 0.13 | 5 | 110 | 0.13 | 3 |
| E | 56% | Emulsion A | " | 90 | 0.15 | 5 | 90 | 0.15 | 3 |
| " | " | Emulsion B | " | 90 | 0.15 | 5 | 90 | 0.15 | 3 |
| " | " | Emulsion C | " | 100 | 0.14 | 5 | 100 | 0.14 | 2 |
| " | " | Emulsion D | " | 110 | 0.13 | 5 | 110 | 0.13 | 2 |

The fixing property was evaluated in 5 grades. A grading of 5 indicated that no residual silver was found. A grading of 4 indicated that when the film is immersed in a sodium sulfide solution, silver sulfide is formed to thereby form color. Hence, residual silver was slightly present, but the film quality was practically acceptable. A grading of 3 indicated that a slight amount of residual silver was visually observed, and the film was not practically acceptable. The gradings of 2 and 1 indicated that the evaluation of fixing property was further decreased in the order of 2 and 1.

It is clearly seen from the results shown in Table 2 that when the developing solutions A, B, C. and D were used, no change in sensitivity occurred after 3 weeks of processing and, the processing was stable. Even when the replenishment rate was as small as 100 ml/$m^2$, good results in accordance with the present invention were obtained. Conventionally, processing has been carried out with a developing solution having a pH of 10.50 and with the replenishment rate of 650 ml per $m^2$, and the change in photographic characteristics was reduced and the processing was stably conducted in a 3-week running period. In the present invention, no change in sensitivity occurs, and the processing is stably conducted over a long period of time even when the replenishment rate is as small as 100 ml/$m^2$. Accordingly, the effects of the present invention are remarkable.

The evaluation of fixing property was good with the solutions after 3-week running when the emulsions A and B of the present invention were used. However, when the comparative developing solution E was used where sodium ion constituted 56 mol % of the entire cation content of the developing solution, the fixing property was degraded. This was due to the developing solution carried over into the fixing solution by processing of the film over a 3-week running period.

EXAMPLE 2

The same developing solution formulations, rinsing water formulation, automatic processor temperature and time and emulsions were used as in Example 1. In this Example, the following fixing solution formulation was used.

Formulation of Fixing Solution

| | |
|---|---|
| Sodium Thiosulfate | 118.5 g (0.75 mol) |
| Sodium Bisulfite | 30.0 g |
| Disodium Ethylenediaminetetraacetate Dihydrate | 0.025 g |
| Diethylene Glycol | 40.0 g |
| Water to make | 1 liter |

The results obtained are shown in Table 3 below. The sensitivity and fog were substantially the same as shown in Table 2 of Example 1. The fixing property was practically acceptable with the solutions after 3-week running when the emulsion A and B of the present invention were used, but the evaluation of fixing property was deteriorated after 3-week running when the comparative developing solution E was used where sodium ion constituted 56 mol % of the entire cation content of the developing solution.

TABLE 3

| Developing Solution | Na (mol %) of the Entire Cation Content of the Developer | Film | | Fresh Solution Sensitivity | Fresh Solution Fog | Fresh Solution Fixing Property | After 3-week running Sensitivity | After 3-week running Fog | After 3-week running Fixing Property |
|---|---|---|---|---|---|---|---|---|---|
| A | 96% | Emulsion A | Invention | 100 | 0.18 | 4 | 100 | 0.18 | 4 |
| " | " | Emulsion B | " | 100 | 0.18 | 4 | 100 | 0.18 | 4 |
| " | " | Emulsion C | Comparison | 110 | 0.17 | 4 | 110 | 0.17 | 2 |
| " | " | Emulsion D | " | 120 | 0.16 | 4 | 120 | 0.16 | 2 |
| B | 96% | Emulsion A | Invention | 90 | 0.15 | 4 | 90 | 0.15 | 4 |
| " | " | Emulsion B | " | 90 | 0.15 | 4 | 90 | 0.15 | 4 |
| " | " | Emulsion C | Comparison | 100 | 0.14 | 4 | 100 | 0.14 | 2 |
| " | " | Emulsion D | " | 110 | 0.13 | 4 | 110 | 0.13 | 2 |
| C | 96% | Emulsion A | Invention | 90 | 0.15 | 4 | 90 | 0.15 | 4 |
| " | " | Emulsion B | " | 90 | 0.15 | 4 | 90 | 0.15 | 4 |
| " | " | Emulsion C | Comparison | 100 | 0.14 | 4 | 100 | 0.14 | 2 |
| " | " | Emulsion D | " | 110 | 0.13 | 4 | 110 | 0.13 | 2 |
| D | 96% | Emulsion A | Invention | 90 | 0.15 | 4 | 90 | 0.15 | 4 |
| " | " | Emulsion B | " | 90 | 0.15 | 4 | 90 | 0.15 | 4 |
| " | " | Emulsion C | Comparison | 100 | 0.14 | 4 | 100 | 0.14 | 2 |

EXAMPLE 3

1. Preparation of Silver Halide Emulsion

Preparation of octahedral silver chlorobromide emulsion having a silver chloride content of 30 mol %

To a container containing an aqueous solution of 32 g of gelatin in one liter of $H_2O$ heated to 40° C., 2.5 g of sodium chloride was added. To the obtained solution with vigorous stirring, 200 ml of an aqueous solution containing 25.6 of silver nitrate and an aqueous solution containing 12.54 g of potassium bromide, 4.12 g of sodium chloride and potassium hexachloroiridate(III) ($1\times10^{-7}$ mol per mol of silver nitrate) were added over a period of 30 minutes using the double jet process. After 10 minutes, 200 ml of an aqueous solution containing 0.55 g of 1-benzyl-4-(2-(1-benzyl-4-pyridinio)ethyl)-pyridinium chloride was added thereto. Furthermore, 600 ml of an aqueous solution containing 128 g of silver nitrate and 600 ml of an aqueous solution containing 62.72 g of potassium bromide, 17.64 g of sodium chloride and potassium hexachloroiridate(III) ($1\times10^{-7}$ mol per mol of silver nitrate) were added thereto over a period of 20 minutes using the double jet process.

After the obtained emulsion was desalted, 68 g of gelatin and 2 g of phenoxyethanol was added thereto. The pH of the emulsion was adjusted to 6.2 to prepare a monodispersed octahedral silver chlorobromide emulsion having a grain size (in terms of an average side length) of 0.23 μm, a coefficient of variation in grain size distribution of 16% and a silver chloride content of 30 mol %.

The emulsion was heated to 70° C., and $3\times10^{-4}$ mol of the following cyanine dye (1) and $1.5\times10^{-3}$ mol of potassium thiocyanate were added thereto, each amount being per mol of Ag.

Cyanine dye (1)

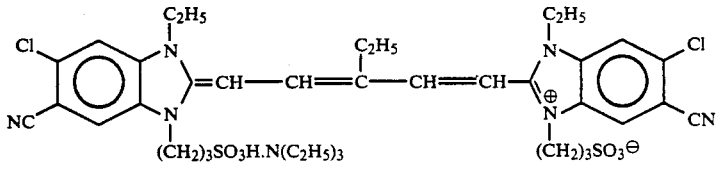

After 30 minutes, the temperature of the emulsion was lowered to 60° C., and sodium thiosulfate and chloroauric acid were added thereto so as to obtain the optimum sensitivity. After ripening, $1.5\times10^{-3}$ mol of 4-hydroxy-6-methyl-1,3,3a,7-tetrazaindene per mol of silver was added thereto to obtain emulsion E.

Preparation of octahedral silver chlorobromide emulsion having a silver chloride content of 80 mol %

To a container containing an aqueous solution of 32 g of gelatin in one liter of $H_2O$ heated to 40° C., 2.5 g of sodium chloride was added. To the obtained solution with vigorous stirring, 200 ml of an aqueous solution containing 25.6 of silver nitrate and an aqueous solution containing 3.58 g of potassium bromide, 8.53 g of sodium chloride and potassium hexachloroiridate(III) ($1\times10^{-7}$ mol per mol of silver nitrate) were added over a period of 15 minutes using the double jet process. After 10 minutes, 200 ml of an aqueous solution containing 0.55 g of 1-benzyl-4-(2-(1-benzyl-4-pyridinio)ethyl)-pyridinium chloride was added thereto. Subsequently, 600 ml of an aqueous solution containing 128 g of silver nitrate and 600 ml of an aqueous solution containing 17.92 g of potassium bromide, 39.67 g of sodium chloride and potassium hexachloroiridate(III) ($1\times10^{-7}$ mol per mol of silver nitrate) were added thereto over a period of 20 minutes using the double jet process.

After the resulting emulsion was desalted, 68 g of gelatin and 2 g of phenoxyethanol were added thereto. The pH of the emulsion was adjusted to 6.2 to prepare a monodispersed octahedral silver chlorobromide emulsion having a grain size (in terms of an average side length) of 0.22 μm, a coefficient of variation in grain size distribution of 17% and a silver chloride content of 80 mol %. The emulsion was heated to 70° C., and $3\times10^{-4}$ mol of the above cyanine dye (1) and $1.5\times10^{-3}$ mol of potassium thiocyanate were added thereto, each amount being per mol of Ag. After 30 minutes, the temperature was lowered to 60° C., and sodium thiosulfate and chloroauric acid were added thereto so as to obtain the optimum sensitivity. After ripening, $1.5\times10^{-3}$ mol of 4 -hydroxy-6-methyl- 1,3,3a,7-tetrazaindene per mol of silver was added thereto to obtain emulsion F.

Preparation of octahedral silver chlorobromide emulsion having a silver chloride content of 99 mol %

To a container containing an aqueous solution of 32 g of gelatin in one liter of $H_2O$ heated to 40° C., 2.5 g of sodium chloride was added. To the obtained solution with vigorous stirring 200 ml containing 25.6 g of silver nitrate and an aqueous solution containing 10.29 g of sodium chloride and potassium hexachloroiridate(III) ($1\times10^{-7}$ mol per mol of silver nitrate) were added over a period of 8 minutes using the double jet process. After 10 minutes, 200 ml of an aqueous solution containing 0.55 g of 1-benzyl-4-(2-(1-benzyl-4-pyridinio)ethyl)-pyridinium chloride was added thereto. Subsequently, 600 ml of an aqueous solution containing 128 g of silver nitrate and 600 ml of an aqueous solution containing 48.48 g of sodium chloride and potassium hexachloroiridate(III) ($1\times10^{-7}$ mol per mol of silver nitrate) were added thereto over a period of 20 minutes using the double jet process.

After the obtained emulsion was desalted, 68 g of gelatin and 2 g of phenoxyethanol were added thereto. The pH of the emulsion was adjusted to 6.2 to prepare a monodisperse octahedral silver chlorobromide emulsion having a grain size (in terms of an average side length) of 0.21 μm, a coefficient of variation in grain size distribution of 17% and a silver chloride content of 100 mol %. The emulsion was heated to 60° C., and 0.01 mol of a fine grain silver bromide emulsion per mol of silver chloride was added thereto. After ripening, the temperature of the emulsion was raised to 70° C., and $3\times10^{-4}$ mol of the above cyanine dye (1) and $1.5\times10^{-3}$ mol of potassium thiocyanate were added thereto, each amount being per mol of silver. After 30 minutes, the temperature of the emulsion was lowered to 60° C., and sodium thiosulfate and chloroauric acid were added thereto so as to obtain the optimum sensitivity. After ripening, $1.5\times10^{-3}$ mol of 4-hydroxy-6-methyl-1,3,3a,7-tetrazaindene per mol of silver was added thereto to obtain emulsion G.

2. Preparation of Emulsion Coating Solution

The following reagents were added to each of the emulsions E, F and G to prepare an emulsion coating solution, each amount being per mol of silver halide.

Formulation of Emulsion Coating Solution

| | |
|---|---|
| Polyacrylamide (M.W. = 40,000) | 9.2 g |
| Trimethylol Propane | 1.4 g |
| Poly(ethyl acrylate/methacrylic acid) Latex | 22 g |

3. Preparation of Coating Solution for Surface Protective Layer for Emulsion Layer, Preparation of Coating Solution for Back Layer and Preparation of Coating Solution for Surface Protective Layer for Back layer The coating solution for the surface protective layer for the emulsion layer, the coating solution for the back layer and the coating solution for the surface protective layer for the back layer were prepared in the same manner as in Example 1.

Photographic materials 5 to 7 having the halogen compositions shown in Table 4 below, were prepared in the same manner as in Example 1 by using the coating solutions prepared above.

The same developing solutions A to E were used as used as in Example 1, and the same fixing solution was used as in Example 1 was used. The processing was carried out in the same manner as in Example 1. The results obtained are shown in Table 5 below.

TABLE 4

| Photographic Material | Emulsion | Halogen Composition |
|---|---|---|
| 5 (Comparison) | E | Cl = 30 mol % (Br 70 mol %) |
| 6 (Comparison) | F | Cl = 80 mol % (Br 20 mol %) |
| 7 (Invention) | G | Cl = 99 mol % (Br 1 mol %) |

TABLE 5

| Developing Solution | Na (mol %) of the Entire Cation Content of the Developer | Photographic Material | | Fresh Solution | | | After 3-week running | | |
|---|---|---|---|---|---|---|---|---|---|
| | | | | Sensitivity | Fog | Fixing Property | Sensitivity | Fog | Fixing Property |
| A | 90% | 5 | Comparison | 100 | 0.16 | 5 | 100 | 0.16 | 3 |
| " | " | 6 | " | 95 | 0.17 | 5 | 95 | 0.17 | 3 |
| " | " | 7 | Invention | 80 | 0.18 | 5 | 80 | 0.18 | 5 |
| B | 90% | 5 | Comparison | 90 | 0.13 | 5 | 90 | 0.13 | 3 |
| " | " | 6 | " | 85 | 0.14 | 5 | 85 | 0.14 | 3 |
| " | " | 7 | Invention | 70 | 0.15 | 5 | 70 | 0.15 | 5 |
| C | 90% | 5 | Comparison | 90 | 0.13 | 5 | 90 | 0.13 | 3 |
| " | " | 6 | " | 85 | 0.14 | 5 | 85 | 0.14 | 3 |
| " | " | 7 | Invention | 70 | 0.15 | 5 | 70 | 0.15 | 5 |
| D | 90% | 5 | Comparison | 90 | 0.13 | 5 | 90 | 0.13 | 3 |
| " | " | 6 | " | 85 | 0.14 | 5 | 85 | 0.14 | 3 |
| " | " | 7 | Invention | 70 | 0.15 | 5 | 70 | 0.15 | 5 |
| E | 50% | 5 | Comparison | 90 | 0.13 | 5 | 90 | 0.13 | 2 |
| " | " | 6 | " | 85 | 0.14 | 5 | 85 | 0.14 | 2 |
| " | " | 7 | " | 70 | 0.15 | 5 | 70 | 0.15 | 3 |

While the invention has been described in detail and with reference to specific embodiments thereof, it will be apparent to one skilled in the art that various changes and modifications can be made therein without departing from the spirit and scope thereof.

What is claimed is:

1. A method for processing a transmission type black-and-white silver halide photographic material which comprises processing an imagewise exposed silver halide photographic material comprising a support having thereon at least one light-sensitive silver halide emulsion layer comprising a silver halide emulsion, wherein said silver halide photographic material comprises silver chlorobromide, silver chloroiodide or silver chloroiodobromide grains having a silver chloride content of at least 90 mol % and a mean grain size of 0.1 to 0.4 μm or silver chloride grains having a mean grain size of 0.1 to 0.4 μm; said processing comprises developing in a developing bath and fixing in a fixing bath and the developing bath contains sodium ion in an amount comprising at least 70 mol % of the entire cation content of the developing bath; the developing bath and the fixing bath are each replenished in an amount of not more than 150 ml per $m^2$ of the photographic material processed; and the processing is carried out in an automatic processor.

2. The method as in claim 1, wherein at least 50 wt % of the silver halide grains having a silver chloride content of at least 90 mol % are cubic grains having a (100) face/(111) face ratio of at least 5.

3. A processing method as in claim 1, wherein at least 50 wt % of the silver halide grains having a silver chloride content of at least 90 mol % are octahedral or tabular grains having a (100) face/(111) face ratio of less than 5.

4. The method as in claim 1, wherein the silver halide grains having a silver chloride content of at least 90 mol % comprise a localized silver bromide phase.

5. The method as in claim 4, wherein the localized silver bromide phase has a silver bromide content of from 10 to 95 mol %.

6. The method as in claim 4, wherein the localized silver bromide phase comprises from 0.03 to 10 mol % of the silver halide of the silver halide grains.

7. The method as in claim 1, wherein the silver halide emulsion of the photographic material is spectrally sensitized with a spectral sensitizing dye having a wavelength sensitivity in the region of 600 nm or more.

8. The method as in claim 1, wherein the developing bath contains at least one of a benztriazole derivative and a nitroindazole compound.

9. The method as in claim 1, wherein the fixing bath contains thiosulfate ion in an amount of at least 0.8 mol/l.

10. The method as in claim 1 further comprising processing in a rinsing or stabilizing bath and drying in a drying zone, wherein the entire processing time (dry to dry) from the beginning of the developing step to the end of the drying step is from 20 to 100 seconds.

11. The method as in claim 1, wherein the developing bath has a pH of 9.8 or less.

* * * * *